US006718924B1

(12) United States Patent
Isaacs et al.

(10) Patent No.: US 6,718,924 B1
(45) Date of Patent: Apr. 13, 2004

(54) DESIGN AND ASSEMBLY METHOD OF A LOW COST CAMSHAFT

(75) Inventors: Carl Isaacs, Waterville, OH (US); Michael A. Kestner, Spring Lake, MI (US); Russ Hite, Centerville, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/251,023

(22) Filed: Sep. 20, 2002

Related U.S. Application Data

(60) Provisional application No. 60/323,835, filed on Sep. 20, 2001.

(51) Int. Cl.[7] ..... F01L 1/04

(52) U.S. Cl. ..... 123/90.6; 123/90.17; 74/567; 29/888.1

(58) Field of Search ..... 123/90.6, 90.16, 123/90.17, 90.31; 74/567; 29/888.1

(56) References Cited

U.S. PATENT DOCUMENTS

| | | | | |
|---|---|---|---|---|
| 3,999,277 | A | 12/1976 | Hamada | 29/447 |
| 4,616,389 | A | 10/1986 | Slee | 29/156.4 R |
| 4,881,680 | A | 11/1989 | Toelke et al. | 228/182 |
| 4,983,797 | A | 1/1991 | McAllister et al. | 219/121.64 |
| 5,197,351 | A | 3/1993 | Hishida | 74/567 |
| 5,664,463 | A | 9/1997 | Amborn et al. | 74/567 |
| 6,006,429 | A | 12/1999 | Hanisch et al. | 29/888.1 |

*Primary Examiner*—Thomas Denion
*Assistant Examiner*—Kyle Riddle
(74) *Attorney, Agent, or Firm*—Rader, Fishman & Grauer PLLC

(57) ABSTRACT

A camshaft assembly and method of making a camshaft assembly is disclosed. Each of the cams includes a lobe boss portion that defines the cam lift profile, and a base portion that provides a surface for joining the cam to the shaft. In contrast to conventional ring-type cams, the base portion of the cam does not circumscribe the outer surface of the shaft, but instead extends only part way around the circumference or periphery of the shaft. This allows for radial mounting of the cams at virtually any timing angle, and permits the use of simple techniques for joining the cams to the shaft, including capacitance discharge welding. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims. 37 CFR 1.72(b).

11 Claims, 7 Drawing Sheets

DESIGN AND ASSEMBLY METHOD OF A LOW COST CAMSHAFT

CLAIM TO PRIORITY

This application claims benefit to provisional patent application No. 60/323,835, filed Sep. 20, 2001, the entire contents of which is incorporated herein by reference.

BACKGROUND OF THE INVENTION

1. Field of the Invention

The present invention relates to a camshaft for use in internal combustion engines, and more particularly, to a cam design and method of assembly.

2. Description of the Related Art

Conventional camshafts used to control valve motion in internal combustion engines include a shaft having axially spaced cams, which project outward from the surface of the shaft. The shaft and cams can be machined from a single casting or forging, but are usually assembled from separate parts. Each cam is mechanically coupled to one of the engine valves so that rotation of the shaft results in valve movement. In addition to the cams, conventional camshafts include journals, fittings, sensors, and balancing masses mounted to the shaft.

FIG. 1 and FIG. 2 show, respectively, a side view of a portion of a conventional camshaft 10, and a cross-sectional view of the camshaft 10 through section line 2. The camshaft 10 includes a tubular shaft 12 having inner 14 and outer surfaces 16 and an annular or ring-type cam 18 mounted on the outer surface 16 of the shaft 12. As shown in FIG. 2, the cam 18 includes a lobe boss portion 20 and a ring portion 22 having respective inner 24, 26 and outer surfaces 28, 30. The inner surface 24 of the lobe boss 20 and the inner surface 26 of the ring portion 22 of the cam 18 define a continuous mounting surface for joining the cam 18 to the outer surface 16 of the shaft 12. During operation of the camshaft 10, the outer surface 28 of the lobe boss 20 generates the desired valve lift, while the outer surface 30 of the ring portion 22 defines a base circle, which provides zero-valve lift. To assemble the conventional camshaft 10, each of the cams 18 are positioned over an end of the shaft 32, translated to a pre-defined axial position, and attached or joined to the outer surface 16 of the shaft 12.

Although generally satisfactory, conventional camshaft designs can be improved. For example, to set the relative angular position of the cams around the periphery of the shaft (timing angle), conventional camshafts typically employ a ring-type cam having polygonal or spline mounting surfaces that interlock with matching surfaces on the outer surface of the shaft. As a result, any necessary adjustments in lift or timing—e.g., changes in the relative angular position of the cams—require costly changes to the shaft and cams. In addition, to reduce overall camshaft weight and cost, recent cam designs have sought to minimize wall thickness of the ring portion of the cam and the shaft. However, insufficient wall thickness may result in undesirable thermal distortion, severe cold working or thinning during assembly, and marginal mechanical performance. Furthermore, ring-type cams often require preprocessing of the shaft, such as forming and precision machining which increases costs and process variability. The wall thickness of the ring portion of the cam also limits the outer diameter of the shaft and journal, which may result in increased journal dynamic bearing loading and decreased camshaft service life.

In many cases, use of ring-type cams also requires complex joining or attachment methods, including shrinkage joining and hydroforming. Although used successfully to assemble camshafts, both techniques present difficulties. For instance, when using shrinkage techniques only a small percentage of the cam mounting surface contacts the outer surface of the shaft. As a result, shrinkage techniques require precision ground components that must be carefully positioned to prevent attachment failures. Although hydroforming may work well on thin wall cams subject to low stress, the method is impractical for relatively high stress loadings of most current automotive and diesel engines. In addition, hydroforming uses large and expensive equipment and tooling, and requires lengthy development time since iterative testing is often necessary to optimize material flow and strength characteristics.

Other complex methods of attachment, such as ballizing, sinter brazing, and liquidous-type expansion joining, also present difficulties. For example, ballizing is an expansion technique requiring the use of highly controlled tube wall and outside shaft geometry as well as an expensive die arrangement for assembly. Common problems with ballizing include part distortion and inconsistent material properties. Sinter brazing uses a filler agent, which adds expense and material coverage problems. It also requires the use of a high temperature furnace and lengthy heating and cooling cycles to process the camshaft assembly, which may lead to thermal distortion of the camshaft. Like shrinkage joining and ballizing, sinter brazing requires precision components to optimize joining characteristics. Finally, liquidous-type expansion techniques employ concentric tubes and a liquid crystalline polyester resin, which is injected into an annular gap between the tubes. Since multiple tubes are used, the method is costly.

The present invention is directed to overcoming, or at least minimizing, one or more of the problems set forth above.

SUMMARY OF THE INVENTION

One aspect of the present invention provides a camshaft assembly for transmitting and controlling valve motion in an internal combustion engine. The camshaft assembly includes a shaft having an outer surface and a longitudinal axis, and a cam that is mounted on the shaft. The cam includes a lobe boss portion having a pair of side walls and a transverse surface. The transverse surface of the lobe boss portion of the cam bridges the pair of side walls and defines a cam profile that provides the requisite valve lift and valve velocity during operation. The cam also includes a base portion that provides a surface for joining the cam to the shaft at a predetermined position along the longitudinal axis of the shaft. In contrast to ring-type cams, the base portion or the mounting surface of the cam does not circumscribe the outer surface of the shaft, but instead extends only part way around the circumference or periphery of the shaft. This allows for radial mounting of the cams at virtually any relative angular displacement or timing angle. Because the cams of the present invention lack a ring portion, the cam width adjacent to the base portion can be made narrower, which allows for greater flexibility in the design of the cam profile shape and the resulting cam lift curves.

Another aspect of the present invention provides a method of assembling a camshaft. The method includes providing components that make up the camshaft, such as a shaft and cams, and radially mounting at least one of the cams on the shaft. The mounting step includes positioning the cam at a pre-mounting location that is spaced away from an outer surface of the shaft and located between ends of the shaft, and placing the cam on the outer surface of the shaft at a mounting angle of about 90°. A mounting angle of 90° corresponds to placing the cam on the shaft normal to a plane containing a longitudinal axis of the shaft. In contrast to assembling ring-type cams, which require complicated joining or attachment methods, radial mounting can use simpler joining methods such as capacitance discharge welding.

DESCRIPTION OF THE PREFERRED EMBODIMENT

Figure 3:
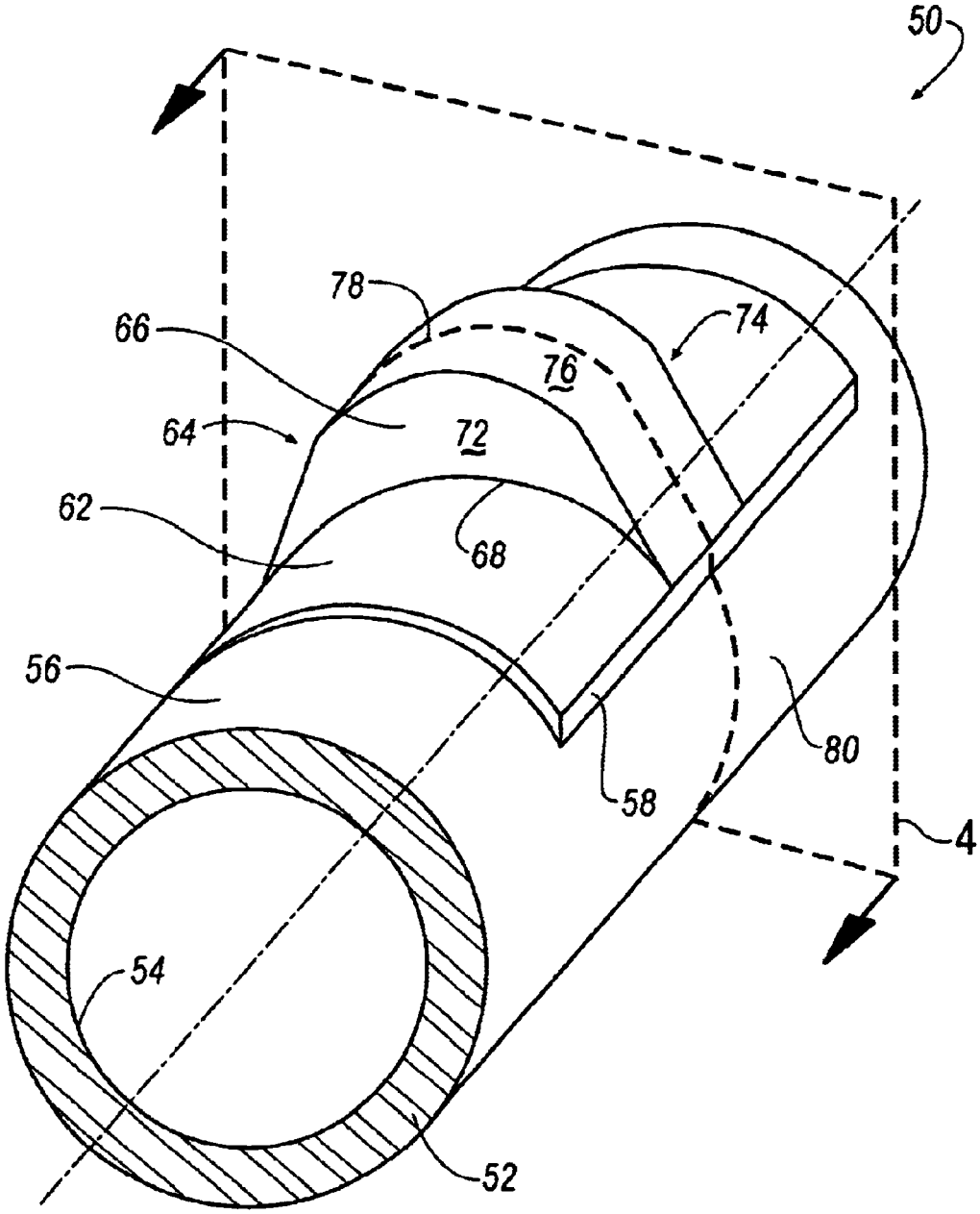
FIG. 3 is a perspective view of a portion of a lobe boss camshaft.
Figure 4:
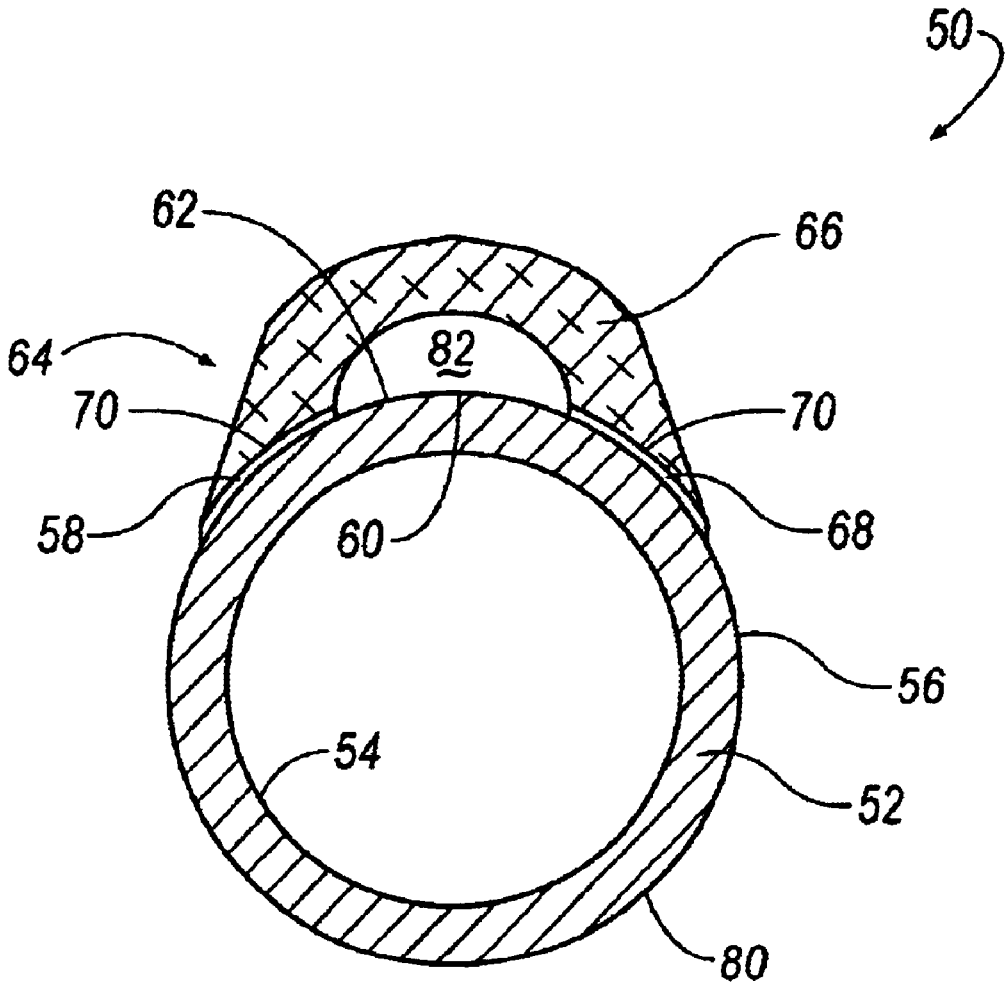
FIG. 4 is a cross-sectional view of a lobe boss camshaft though section plane 4 of FIG. 3.

FIG. 3 and FIG. 4 show, respectively, a perspective view of a lobe boss portion of a camshaft 50, and a cross-sectional view of the camshaft 50 through section plane 4. The camshaft 50 includes a tubular shaft 52 having inner 54 and outer surfaces 56 and having adequate torsion resistance and stiffness for valve-train actuation. An optional base plate 58 is mounted on the outer surface 56 of the shaft 52, providing additional joining strength. The base plate 58 includes an inner surface 60 and an outer surface 62. The inner surface 60 of the base plate 58 shown in FIG. 4 defines an arcuate mounting surface, through generally, the inner surface 60 conforms to the outer surface 56 of the shaft 52.

Figure 1:
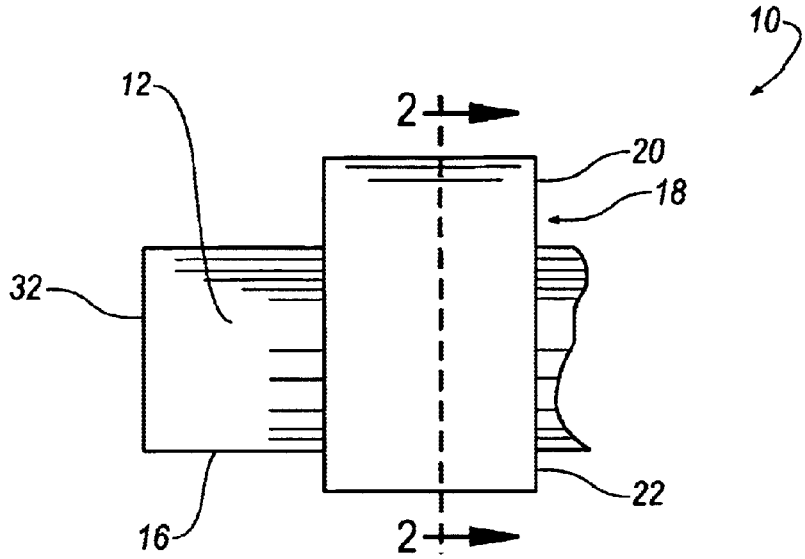
FIG. 1 (PRIOR ART)
FIG. 1 is a side view of a portion of a conventional camshaft.
Figure 2:
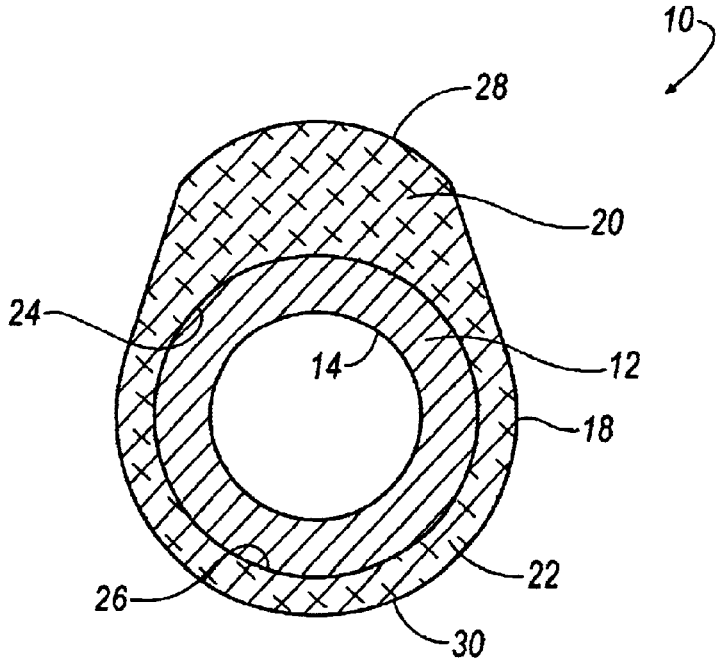
FIG. 2 (PRIOR ART)
FIG. 2 is a cross-sectional view of a conventional camshaft through section line 2 of FIG. 1.

As can be seen in FIG. 3 and FIG. 4, the camshaft 50 includes a cam 64 that is radially mounted on the outer surface 62 of the base plate 58, though the cam 64 can be mounted directly on the outer surface 56 of the shaft 52. The cam 64 includes a lobe boss portion 66 and a base portion 68. The base portion 68 of the cam 64 provides a mounting surface for joining the cam 64 to the outer surface of the base plate 62 or to the outer surface of the shaft 56. In contrast to the ring-type cam of FIG. 1, the base portion 68 or the mounting surface 70 of the cam 64 does not circumscribe the outer surface 56 of the shaft 52, but instead extends only part way around the circumference or periphery of the shaft 52. As described below, this allows radial mounting of the cams at virtually any relative angular displacement. The lobe boss portion 66 of the cam 64 includes a pair of generally planar faces or side walls 72, 74 and a transverse surface 76, which bridges the pair of faces 72, 74 and defines a cam profile 78. During operation, the cam profile 78 generates the requisite cam lift curve and velocity, and an exposed portion 80 of the outer surface 56 of the shaft 52 defines a base circle that provides zero-valve lift. Because the camshaft 50 shown in FIG. 3 and FIG. 4 lacks the ring portion 22 of conventional cam 10, the camshaft 50 width adjacent to the base portion 68 can be made narrower than in conventional ring-type cams 10. This allows for greater flexibility in the design of the cam profile 78 shape and the resulting cam lift curves. The camshaft 50 is generally made of ferrous alloys, such as steel, but can also be made of aluminum, polymeric composites, and other materials known in the art.

To reduce mass and cost, the cam 64 may include a hollow portion or cavity 82 located within the lobe boss 66. Alternatively or additionally, the cam 64 may include one or more apertures (not shown) extending through the cam 64 between the faces 72, 74 of the lobe boss 66. Ordinarily, such mass saving structures can be used whenever camshaft surface life and loading requirements permit.

Figure 5:
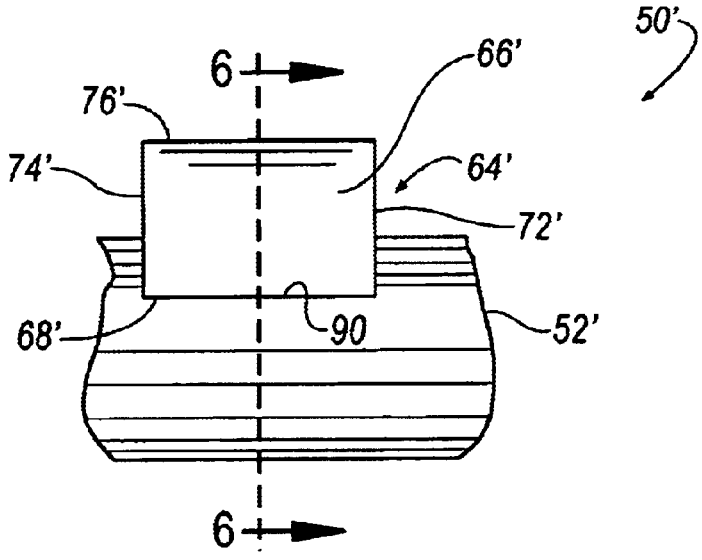
FIG. 5 is a side view of a portion of a flat-bottom lobe boss camshaft.
Figure 6:
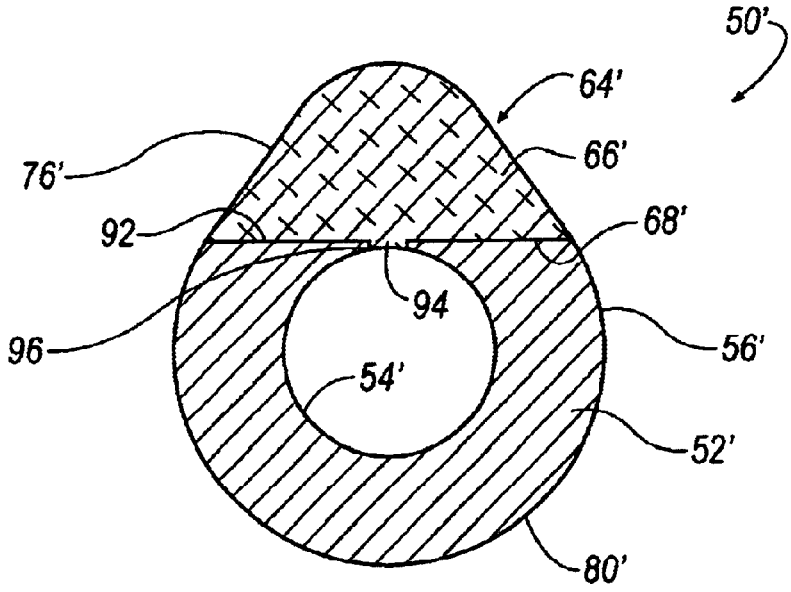
FIG. 6 is a cross-sectional view of a flat-bottom lobe boss camshaft through section line 6 of FIG. 5.

Another embodiment is shown in FIG. 5 and FIG. 6, which provide, respectively, a perspective view of a camshaft portion 50', and a cross-sectional view of the camshaft portion 50' through section line 6. The camshaft 50' includes a tubular shaft 52' having inner 54' and outer surfaces 56', and a cam 64' that is radially mounted on the outer surface 56' of the shaft 52'. As can be seen in FIG. 6, the cam 64' includes a lobe boss portion 66' and a base portion 68'. Like the embodiment shown in FIG. 3 and FIG. 4, the base portion 68' of the cam 64' does not circumscribe the outer surface 56' of the shaft 52' but leaves exposed a portion 80' of the outer surface 56' of the shaft 52' that serves as a base circle. The lobe boss portion 66' of the cam 64' also includes a pair of generally planar faces or side walls 72' and 74', and a transverse surface 76' that bridges the pair of faces 72' and 74' and defines a cam profile. In contrast to the embodiment shown in FIGS. 3 and 4, however, the base portion 68' of the cam 64' fits into a notch 90 having a substantially flat mounting surface 92 formed on the outer surface 56' of the shaft 52'. The camshaft 50' may include optional pin 94 and locator holes 96 on the base portion 68' of the cam 64' and the mounting surface 92 of the notch 90, respectively. The pin 94 and corresponding locator hole 96 help position and secure the cam 64' in the notch 90 during assembly. The pin 94 may also serve as a weld stud for joining the cam 64' to the shaft 52', depending on the pin's 94 response to heat, pressure, electrical current, and the like, that can be applied during assembly of the camshaft 50'. In one respect, the notched camshaft 50' is a less flexible design than shafts having constant radius mounting surfaces (FIG. 3 and FIG. 4) since each notch 90 sets the timing angle for a given cam, making it difficult to effect changes in the cam lift curve or valve timing.

Figure 7:
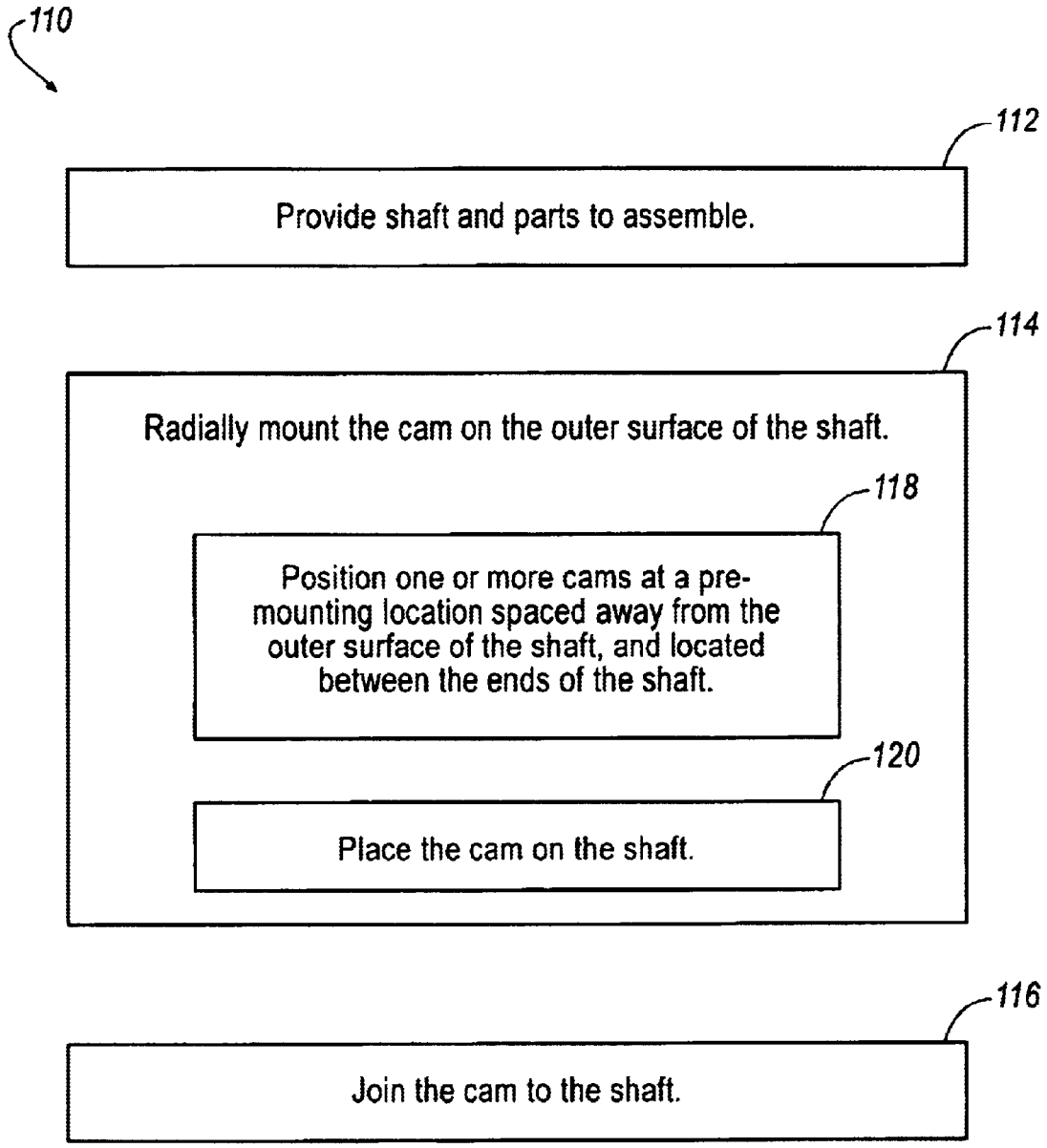
FIG. 7 is a flow chart of an assembly method for a low cost camshaft.
Figure 8:
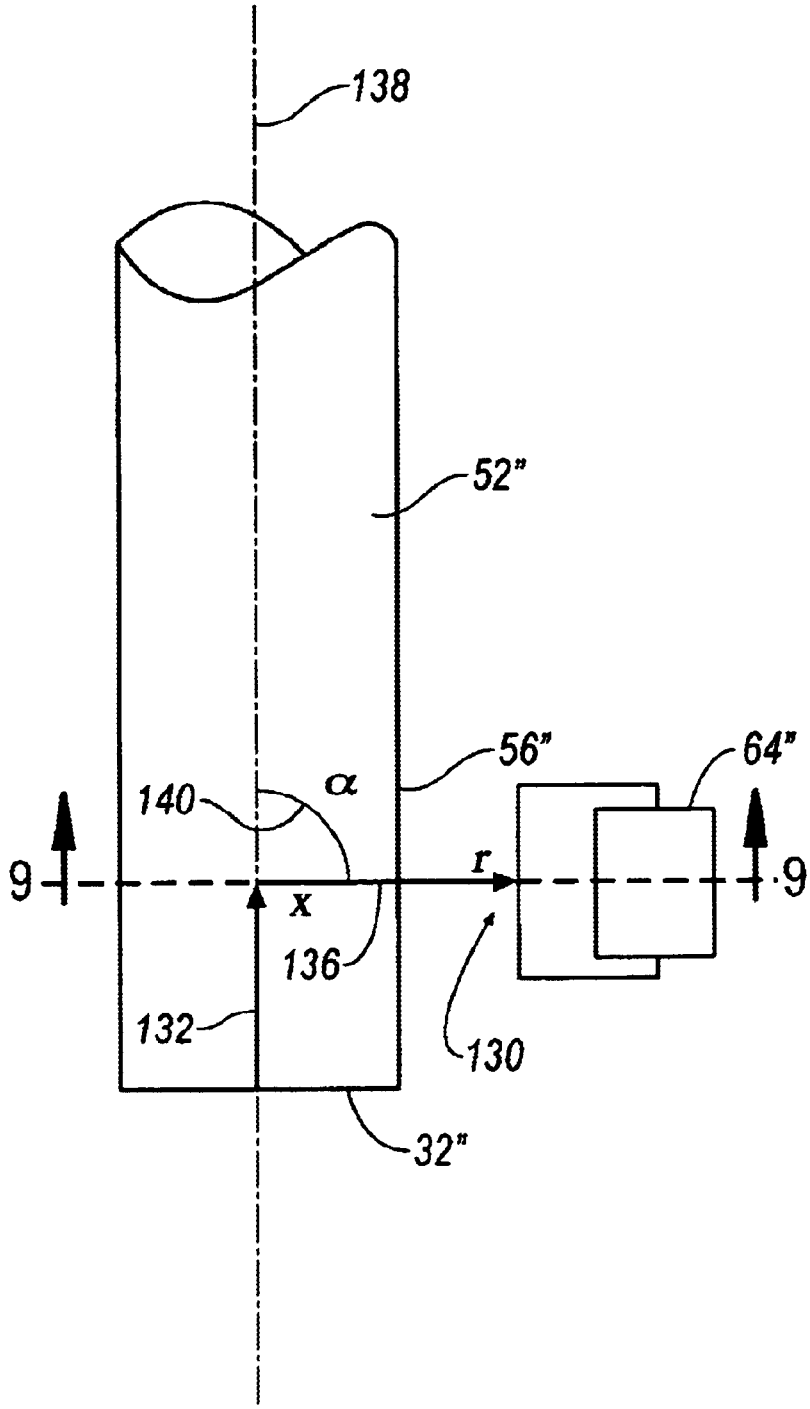
FIG. 8 is a top view of a portion of a shaft during assembly.
Figure 9:
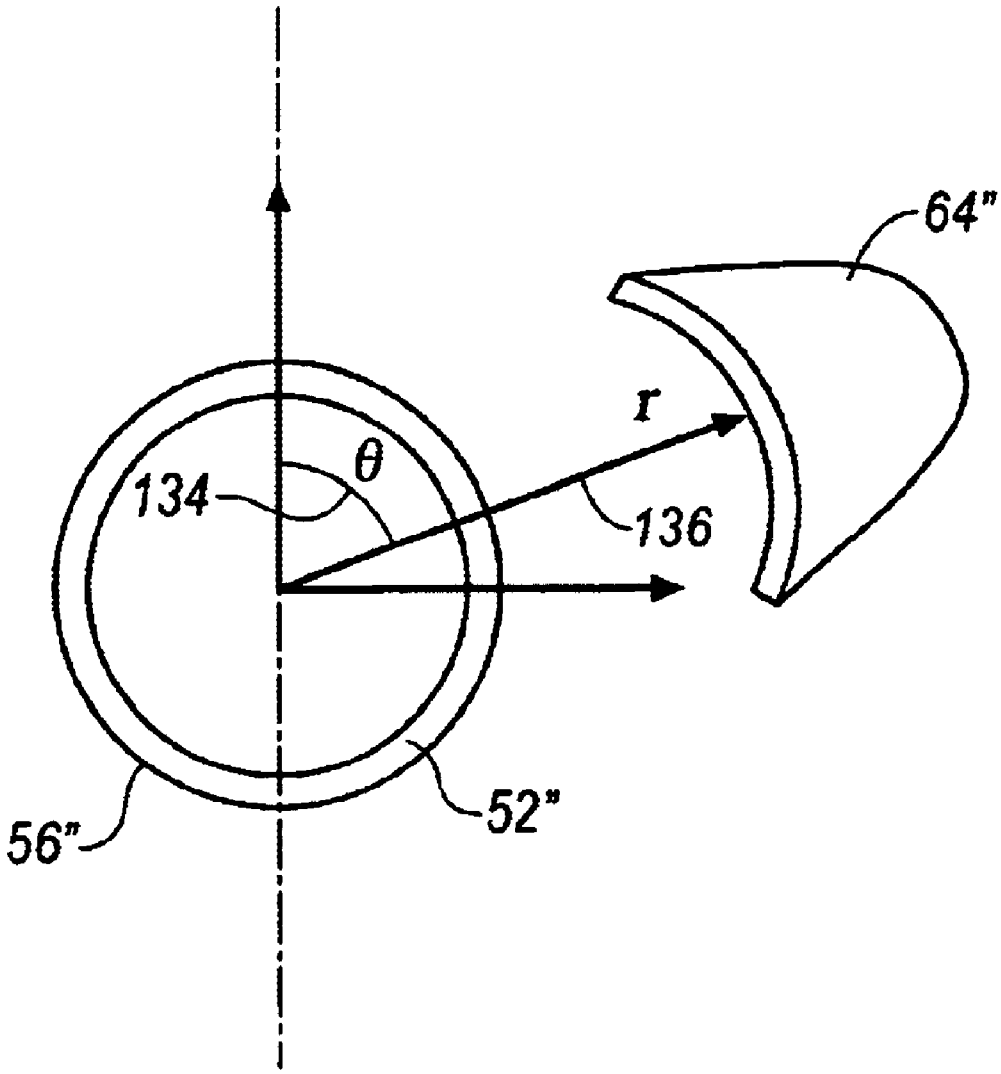
FIG. 9 is a cross-sectional view of a shaft through section line 9 of FIG. 8.

FIG. 7, FIG. 8 and FIG. 9 illustrate a method 110 of assembling a camshaft for use in a valve train assembly of an internal combustion engine. As noted in the flow chart shown in FIG. 7, the method 110 includes providing 112 components that comprise the camshaft, including a shaft having the requisite torsion resistance, stiffness, and strength for valve train actuation, and cams having base portions that allow radial mounting on the shaft. Other components may include base plates—if needed to provide additional joining strength between the cams and the shaft—and any gears, fittings, journals, sensors, balancing masses, end fittings, and the like. Suitable components include shafts, cams, and base plates shown in FIG. 3–FIG. 6.

As described in FIG. 7, the method 110 also includes radially mounting 114 the cams 64" at predetermined positions on the outer surface of the shaft 52" and, once mounted 114, joining 116 the cams 64" to the shaft 52".

This process can best be seen in FIG. 8 and FIG. 9, which show, respectively, a top view of a portion of a shaft 52" during assembly, and a cross-sectional view of the shaft 52" through section line 9. Radially mounting 114 the cams 64" includes positioning 118 one or more of the cams 64" at a desired pre-mounting location 130 and then placing 120 the cam 64" on the outer surface 56" of the shaft 52". The pre-mounting location 130 is spaced away from the outer surface 56" of the shaft 52" and located between the ends 32" of the shaft 52". As shown in FIG. 8 and FIG. 9, the pre-mounting location 130 can be represented by longitudinal distance 132, x, timing angle 134, θ, and radial distance 136, r, although any suitable coordinate system can be used (including a cylindrical coordinate system employing a different origin). Positioning 118 can be accomplished using a device capable of moving the cam 64" or the shaft 52" or the cam 64" and the shaft 52". One useful device includes a computerized numerically controlled (CNC) machine having a translation stage adapted to move the cam 64" (or other camshaft parts) in three dimensions and a rotary fixture adapted to rotate the shaft 52" about its longitudinal axis 138. Positioning 118 can occur by successive translation and rotation of the cam 64" and shaft 52", respectively, or by simultaneous translation and rotation of the cam 64" and the shaft 52".

Once the cam 64" is at the pre-mounting location 130, it is placed 120 or mounted on the outer surface 56" of the shaft 52" at a mounting angle 140, α, that is about normal to a plane containing the longitudinal axis 138 of the shaft 52". A mounting angle 140 of about 0° or 180° corresponds to mounting conventional ring-type cams 18 that are slipped over an end of the shaft 34 and translated to a predefined position along the longitudinal axis 138 (cf. FIG. 1 and FIG. 8). The mounting step 114 can be performed in a reducing or inert atmosphere, which helps to produce a higher quality joint.

Once mounted 114, the cams 64" can be joined 116 to the shaft 52" using any number of techniques, including resistance welding, which comprises applying weld energy to the parts to be joined for specified time interval. Resistance welding can produce at least three different bonds: brazed or soldered bonds, forged welds, and fusion welds. To produce brazed or soldered bonds, resistance heating of the cam and the shaft melts a third metal, such as silver solder alloy or tin/lead solder, which bonds to both parts. To produce forged welds, a short weld-time current is used to forge the parts together without melting them, which is useful when the cams and shaft are made of different materials. To produce fusion welds, a longer pulse is used to melt the cam and the shaft along their points of contact. Fusion welding is useful when the cams and shaft are made of two similar materials.

Resistance welding systems are distinguished by the method of applying energy to the parts, i.e., direct energy (alternating current), stored energy (capacitance discharge), and high-frequency direct-current (HFDC). Of these, capacitance discharge welding (CDW) is particularly advantageous because it can be used to join materials that are susceptible to thermal fracturing or undesirable phase formation, and because, compared to other welding techniques, CDW results in relatively thin welds and narrow heat-affected zones. Most CDW systems provide weld energy as a series of current pulses, resulting in high cooling rates in excess of $10^2$ K/s. Dual or multi-pulsing is especially useful for joining coated or plated materials: a first pulse displaces surface oxides and a second pulse welds the underlying materials. Multiple pulses can also preheat or postheat the cam and shaft and can control overall temperature profiles to prevent material expulsion and cracking. Moreover, capacitance discharge systems can reverse the polarity of the sequential pulses, which is useful for welding dissimilar or polarity-sensitive parts.

It is to be understood that the above description is intended to be illustrative and not restrictive. Many embodiments will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, if any, including patent applications and publications, are incorporated herein by reference for all purposes.

While the invention has been specifically described in connection with certain specific embodiments thereof, it is to be understood that this is by way of illustration and not of limitation, and the scope of the appended claims should be construed as broadly as the prior art will permit.

What is claimed is:

1. A camshaft assembly for transmitting and controlling valve motion in an internal combustion engine, the camshaft assembly comprising:

a shaft having an outer surface and a longitudinal axis, and a cam mounted on the shaft, the cam comprising:

a lobe boss having a pair of side walls and a transverse surface, the transverse surface bridging the pair of side walls and defining a cam profile, and a base that provides a surface for joining the cam to the shaft at a predetermined position along the longitudinal axis of the shaft, the base of the cam extending part way around the outer surface of the shaft at the predetermined position along the longitudinal axis so that the cam can be radially mounted on the shaft during assembly.

2. The camshaft assembly of claim 1, wherein a portion of the outer surface of the shaft adjacent the cam provides a base circle during valve motion.

3. The camshaft assembly of claim 1, wherein the shaft is a generally cylindrical tube.

4. The camshaft assembly of claim 1, further comprising a base plate disposed between the base of the cam and the outer surface of the shaft.

5. The camshaft assembly of claim 1, wherein the lobe boss has an aperture extending through the pair of side walls.

6. The camshaft assembly of claim 1, wherein the lobe boss of the cam defines a cavity.

7. The camshaft assembly of claim 1, wherein the lobe boss portion of the cam includes a cavity disposed within the pair of side walls and the transverse surface.

8. The camshaft assembly of claim 1, wherein the outer surface of the shaft includes a notch, the notch sized to accommodate the base of the cam.

9. The camshaft assembly of claim 1, wherein the base of the cam includes a locating pin.

10. The camshaft assembly of claim 9, wherein the locating pin is a weld stud.

11. A camshaft assembly for transmitting and controlling valve motion in an internal combustion engine, the camshaft assembly comprising:

a tubular shaft having a generally cylindrical outer surface and a longitudinal axis, a base plate mounted on the outer surface of the shaft at a predetermined position along the longitudinal axis of the shaft, and a cam mounted on the base plate, the cam comprising:

a lobe boss having a pair of side walls and a transverse surface, the transverse surface bridging the pair of side walls and defining a cam profile, and a base that provides a surface for joining the cam to the base plate, wherein the base of the cam and the base plate extend part way around the outer surface of the shaft at the predetermined position along the longitudinal axis so that the cam can be radially mounted on the shaft during assembly.

* * * * *